US005381778A

United States Patent [19]

D'Andrade et al.

[11] Patent Number: 5,381,778

[45] Date of Patent: Jan. 17, 1995

[54] PRESSURIZED TOY ROCKET WITH RAPID ACTION RELEASE MECHANISM

[76] Inventors: Bruce M. D'Andrade, 3 Ten Eyck Rd., Whitehouse Station, N.J. 08889; Lonnie G. Johnson, 4030 Ridgehurst Dr., Smyrna, Ga. 30080

[21] Appl. No.: 87,480

[22] Filed: Jul. 2, 1993

[51] Int. Cl.[6] ..... F41B 11/26; F41B 11/28; F41B 11/32

[52] U.S. Cl. ..... 124/69; 124/73; 124/75; 446/429

[58] Field of Search ..... 124/56, 63, 69, 70, 124/71, 73, 74, 75, 76; 446/56, 196, 212, 429

[56] References Cited

U.S. PATENT DOCUMENTS

| | | | |
|---|---|---|---|
| 2,733,699 | 2/1956 | Krinsky . | |
| 2,927,398 | 3/1960 | Kaye et al. . | |
| 3,025,633 | 3/1962 | Kaye et al. . | |
| 3,049,832 | 8/1962 | Joffe . | |
| 3,121,292 | 2/1964 | Butler et al. | 446/212 |
| 3,740,896 | 6/1973 | Glass et al. | 446/212 |
| 3,950,889 | 4/1976 | Dabney | 446/212 |
| 3,962,818 | 6/1976 | Pippin, Jr. . | |
| 4,223,472 | 9/1980 | Fekete et al. | 124/70 X |
| 4,411,249 | 10/1983 | Fogarty et al. | 124/64 |
| 4,897,065 | 1/1990 | Fertig et al. | 446/63 |
| 5,032,100 | 7/1991 | Goldfarb | 446/187 |
| 5,197,452 | 3/1993 | Johnson et al. | 124/57 |

FOREIGN PATENT DOCUMENTS 2587911 4/1987 France .

*Primary Examiner*—Randolph A. Reese
*Assistant Examiner*—John A. Ricci
*Attorney, Agent, or Firm*—Kenneth P. Glynn

[57] ABSTRACT

The present invention involves a pressurized air propelled rocket and rocket launcher toy device. The launcher has a housing which includes a vessel for holding pressurized air therein, an inlet to the vessel and an outlet from the vessel. Also, the housing has a jet tube extending from the outlet and adapted to connect with a rocket. A pump is connected to the vessel inlet of the housing, the pump is connected for and capable of pumping air into the vessel at a pressure sufficient to launch the rocket assembly. A one way valve is connected to the pump and permits the flow of air only from the pump to the vessel. There is a rocket double action, rapid fire release mechanism located in the housing with a first valve which, when released, causes a decrease in pressure to cause a second valve to open. The opening of the second valve releases pressurized air into the rocket to launch it. In preferred embodiments, there is also included a safety mechanism to prevent horizontal or lateral launching.

19 Claims, 2 Drawing Sheets

PRESSURIZED TOY ROCKET WITH RAPID ACTION RELEASE MECHANISM

BACKGROUND OF THE INVENTION

1. Field of the Invention

The present invention is directed to a pressurized air propelled rocket launcher and rocket toy device. More specifically, it is directed to a toy which propels a rocket in a generally upward direction by a pressurized air propulsion. Further, the present invention utilizes a rocket, a pump, a pressurized vessel and a double action, rapid release whereby pressurized air is pumped into the vessel, and the rocket is subsequently released for propulsion. Thus, the present invention pertains in general to motive type rockets which are launched by hand operation and without chemicals, motors, batteries or other power.

2. Information Disclosure Statement

Toys involving launchers have been around for at least thirty or forty years and apparently emerged with modern rocketry, although not all such toys pertain directly to rockets. Over the years various types of jet-powered toys have been developed which rely upon pressurized liquid or air within a container or for launching.

U.S. Pat. No. 2,733,699 issued to B. Krinsky describes a rocket toy using a pressurized launcher and a spring mechanism for initial thrust. Pressurized air is created by a hand pump and a resilient washer (42) is used to retard launching until adequate pressure is achieved.

U.S. Pat. No. 2,927,398 issued to Kaye et al describes a multi-stage rocket in which fluid within chambers in each of multiple stages of a rocket are pressurized and sequentially released. Similarly, U.S. Pat. No. 3,962,818 issued to Reginald Pippin describes a multi-stage rocket with mechanisms for pressurizing liquid within containers for each stage.

U.S. Pat. No. 3,740,896 to Marvin Glass et al describes a jet-powered vehicle wherein a wheeled vehicle has a chamber or container within it and has a launching device which includes an air pump with a one-way valve. There is also clamp means for holding the vehicle in the charging position and a trigger means for releasing the clamping device following the charging of the chamber to permit the vehicle to be propelled by means of reaction of the jet drive.

U.S. Pat. No. 4,223,472 describes a toy missle launching device which utilizes pressurized air. It involves a complex system which includes a large launching guide pipe, a complex mechanical release mechanism and a three position valve member for a complex pumping and launching.

U.S. Pat. No. 4,411,249 issued to Bonnie Fogarty et al describes a toy glider with a pneumatic launcher. In this device, a wristlet includes a pumping mechanism as well as a flexible conduit to which a glider may be attached. The pump is used to pressurize and pneumatically project the glider.

U.S. Pat. No. 4,897,065 issued to John Fertig describes a toy vehicle and hand held pneumatic launcher wherein the pumping mechanism has a piston and hollow cylinder designed for a particular type of grip of a child coupled with thumb or hand operation of the pump mechanism.

U.S. Pat. No. 5,032,100 issued to Adolf Goldfarb describes a toy vehicle and launcher which uses contractive power of liquid in a liquid expanded chamber to propel the vehicle. Here, a significantly large reservoir is utilized to fill and expand a bladder which is connected to and part of a transporter or toy vehicle. It is the expanded, pressurized bladder with the air and water mixture which propels the vehicle as a result of the contraction of the bladder upon release of the vehicle.

U.S. Pat. No. 3,025,633 to Kaye et al describes a rocket launcher having a multipositional valve connected to pressurized liquid and to a launch base. In one position, the valve permits pressurization of a rocket, and, in a second position, the valve releases pressure to unlatch the pressurized rocket for launching.

U.S. Pat. No. 3,049,832 to Joffe describes a two stage liquid rocket which has two pressure chambers, the pressure in one dropping slowly and in the other dropping rapidly so as to result in a time-controlled release of a second stage of the rocket.

U.S. Pat. No. 3,121,292 sets forth a two stage air pressurized rocket toy which has the first two stages propelled together and, after both stages have travelled a substantial distance, the second stage is propelled from the first stage. The air pressure in the first chamber maintains closed valve for a second chamber until a pressure decrease occurs in the first chamber.

French Patent No. 2,587,911 (National Registration No. 85 14705) to Jean-Paul Soulard describes a disengageable sealing wherein a pre-pressurized rocket is released by a pressure decrease which causes a launch valve to release the pressure in the rocket to effect launching.

U.S. Pat. No. 5,197,452 issued to the inventors herein describes a liquid jet propelled transporter and launcher toy which includes a pressurizing mechanism to pressurize air stored with liquid for launching a transporter. A trigger release mechanism is used to fire the transporter.

Notwithstanding the prior art in this field, no patent teaches or renders obvious the present invention device which utilizes a pressurized launcher with a rocket which has a double action, rapid release mechanism in which a first valve is opened to cause a pressure drop to open a second valve which causes the rocket launching.

SUMMARY OF THE INVENTION

The present invention involves a pressurized air propelled rocket and rocket launcher toy device. The launcher has a housing which includes a vessel for holding pressurized air therein, an inlet to the vessel and an outlet from the vessel. Also, the housing has a jet tube extending from the outlet and adapted to connect with a rocket. A pump is connected to the vessel inlet of the housing, the pump is connected for and capable of pumping air into the vessel at a pressure sufficient to launch the rocket assembly. A one way valve is connected to the pump and permits the flow of air only from the pump to the vessel. There is a rocket double action, rapid fire release mechanism located in the housing with a first valve which, when released, causes a decrease in pressure to cause a second valve to open. The opening of the second valve releases pressurized air into the rocket to launch it. In preferred embodiments, there is also included a safety mechanism to prevent horizontal or lateral launching.

BRIEF DESCRIPTION OF THE DRAWINGS

The present invention as described herein will be more fully understood and appreciated when taken in conjunction with the drawings appended hereto those drawings are as follows.

DETAILED DESCRIPTION OF THE INVENTION

The present invention toy has been developed to create a rocket assembly which is air pressure propelled and which may, preferably, be launched by hand, i.e. from a hand held position, and enabling the user to effectively accomplish this in a manner which utilizes an air pressure built up in a vessel and portions of the launcher, followed by air pressure propulsion caused by pressurized air being released to the rocket via the double action, rapid fire release mechanism. Uniquely, the present invention toy includes a launcher which has a housing with a pressurizeable vessel, as well as the double action, rapid release mechanism.

Thus, it is an object of the present invention to provide an advanced toy for launching rockets and similar substantially vertically launched aerodynamic projectiles and any other form of substantially vertically launched transporters, which can be imagined or may yet to be developed in an exciting and efficient manner. (Thus the words "rocket" and "rocket assembly" should be taken to mean substantially vertically launched aerodynamic projectiles or transporters.)

Figure 1:
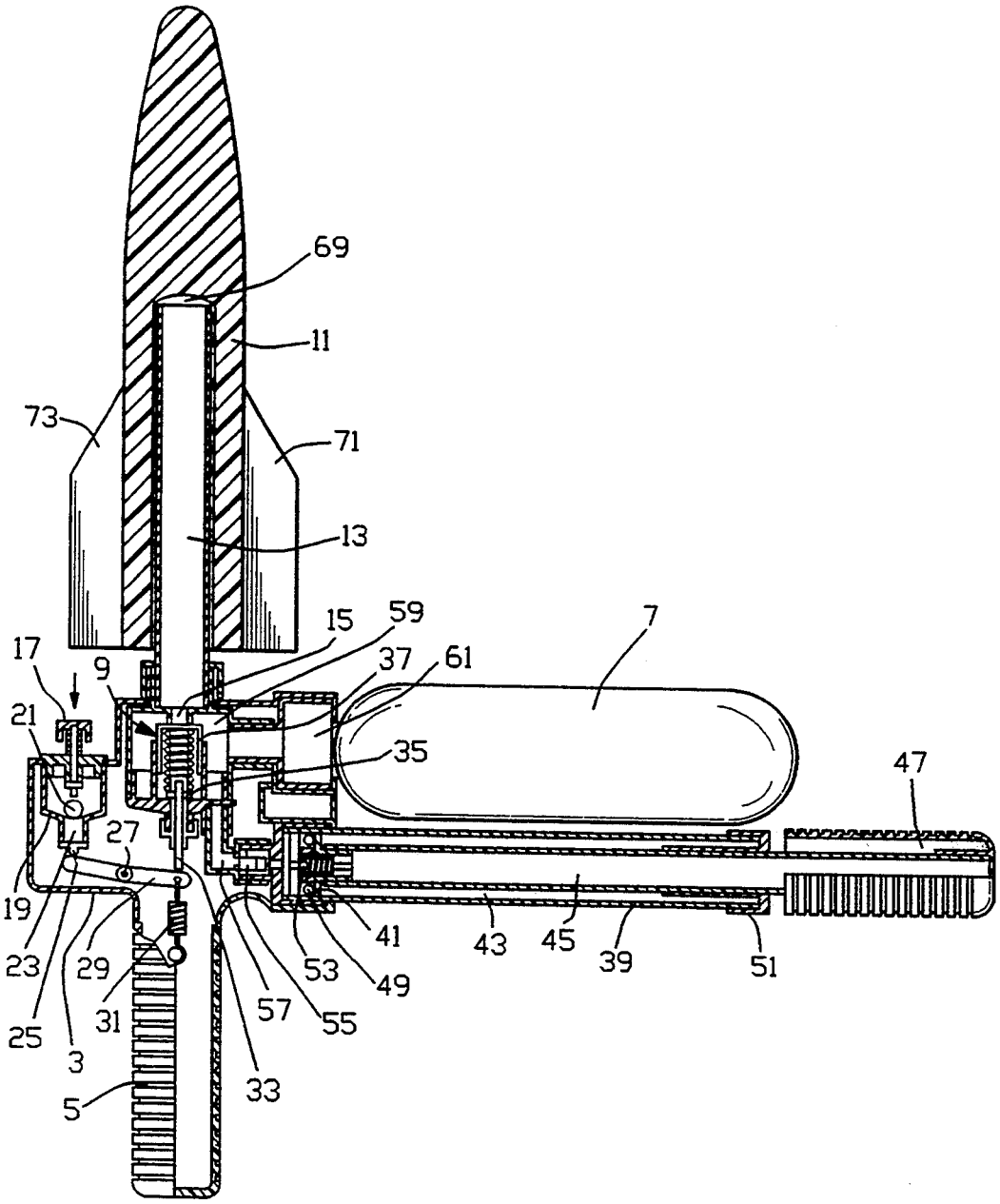
FIG. 1 shows a front elevation view, partially in vertical cross-section, of a present invention toy device, including a pump, a launcher, a rocket, and a double action, rapid release mechanism; and, FIG. 2 is a partial front elevation view, partially in vertical cross-section, of a portion of the present device shown in FIG. 1 to illustrate further detail.
Figure 2:
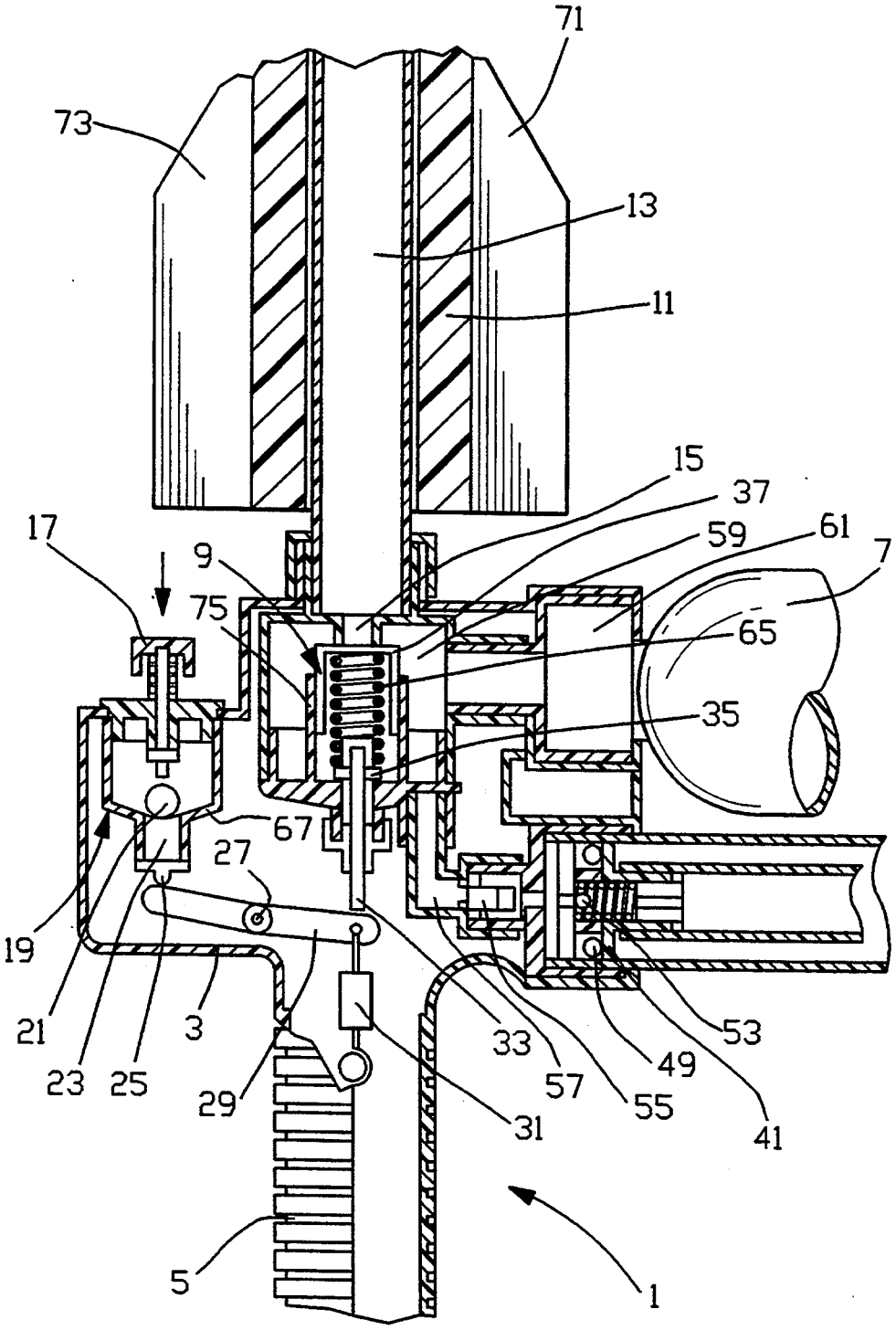

Referring now to FIGS. 1 and 2, together there are shown front elevation views, partially in vertical cross-section, with FIG. 2 being a blown up of a portion of FIG. 1. Present invention toy device 1, includes a launcher shown as main housing 3, optional handle 5 for hand held launching, and pressurizable vessel 7. There is a rocket 11 with a cavity or reservoir 69.

Housing 3 includes double action, rapid release mechanism 9. It is a double action mechanism because the opening of first pressure release valve 35 causes the opening of second pressure release valve 37, also resulting in rapid decompression of the pressurized portions of housing 3 and vessel 7 and the launching of rocket 11.

Double action, rapid release mechanism 9 is connected to launch tube 13 and rocket 11, e.g. a foam rocket with fins such as fins 71 and 73, fits over launch tube 13 at its reservoir 69, as shown. Launch tube 13 is connected to mechanism 9 via launch tube inlet 15. Launch activator 17, in this example, a button, extends outwardly from housing 3 for manual activation (via pressing). When activator 17 is pressed down, depression pin 25 depresses rocker arm 29 about pivot 27. Rocker arm 29 is generally held away from pin 33 via spring 31, but when activator 17 is pressed down and pin 25 moves rocker arm 29, the rocker arm 29 then pushes up release pin 33. Assuming that pressurization has already been accomplished, pin 33 opens first pressure release valve 35 (normally closed by spring 65). This caused compressed air to exit from the pressurized portions of housing 3 and vessel 7 to a slight degree, due in part to the limited amount of opening of valve 35. This pressure decrease causes a pull downwardly on second pressure release valve 37 to open it. This allows the pressured air to rapidly expand through launch tube inlet 15 and tube 13 to thereby rapidly launch rocket 11. Note that, in this embodiment, both valve 35 and valve 37 are nested or located within well 75, and that lower portion of well 75 contains valve 35 and upper portion contains valve 37. Also, these valves are in linear alignment, as shown.

There is an optional safety mechanism 19 which includes ball 21 and dead button socket 23, as well as funnel 67. When safety mechanism 19 is vertical, ball 21 seats over socket 23 and when activator 17 is pressed, is presses on ball 21 to push pin 25 against rocker arm 29 to cause ultimate launching. However, when mechanism 19 is tilted, ball 21 will roll away from its seated position, and, if activator 17 is pressed in this mode, it will enter into socket 23, not move pin 25, not rotate arm 29 and, therefore, not activate a launch. This will prevent a user from firing a rocket at another person, for example, the exact angle of the funnel wall will dictate the degree of tilt that will deactivate launch capabilities, and angle selection is a matter of choice, e.g. 150 or 2000 from vertical would work effectively.

Also, shown in FIGS. 1 and 2 is pump 39 with piston 41 which is within piston chamber 43, and piston rod 45 attached to piston 41. Piston pump handle 47 extends beyond the outer end of piston rod 45 and may be reciprocated so as to pump air into the vessel 7 through one way O-ring valve 49 located around piston 41 and connected thereto, as shown. Piston housing cap 51 supports piston rod 45 and handle 47. Pressure Release valve 53 is on center, surrounded by piston 41, as shown in the figure. Air is taken into piston chamber 43 at the opening around piston rod 45 at cap 51. This occurs when piston pump handle 47 is pulled outwardly and O-ring valve 49 moves away from the sealing position and allows air to pass by piston 41 such that air fills piston chamber 43. When piston pump handle 47 is pushed inwardly, the air within the piston housing is forced by one way O-ring valve 49 past one way valve 55, through tube 57 located in housing 3 to cavity 59, inlet 61 and vessel 7, and, when activated as discussed above, into launch tube inlet 15 and into launch tube 13 for launching. Prior to activation, further pumping increases the air pressure in the vessel 7 and in the pressurized components within housing 3. However, if a predetermined maximum acceptable pressure is reached, pressure release valve 53 prevents further pressure build up.

The construction of the present invention toy device is, typically, of various types of plastic and, once the invention is appreciated, the selection of soft and hard plastics for various components will be within the skill of the artisan. For example, high density polyethylene may be used for certain aspects whereas other plastics may be utilized, for example, tubing could be typical vinyl tubing and the fittings could be hard rubber fittings or otherwise. Additionally, some or all parts may be made of other materials such as materials typically available in the construction of toys, including rigid and flexible foams, metals, graphite, etc.

Obviously, numerous modifications and variations of the present invention are possible in light of the above teachings. It is therefore understood that within the scope of the appended claims, the invention may be practiced otherwise than as specifically described herein.

What is claimed is:

1. A pressurized air propelled rocket launcher and rocket toy device, which comprises:

(a) a launcher having a housing which includes a vessel for holding pressurized air therein, an inlet to said vessel and an outlet from said vessel, and said housing having a launch tube extending from said outlet and adapted to connect with a launchable rocket assembly;

(b) a pump connected to said vessel inlet of said housing, said pump being connected for and capable of pumping air into said vessel at a pressure sufficient to launch said rocket;

(c) a one-way valve connected to said pump and permitting flow of air only from said pump to said vessel;

(d) a rocket which includes a rocket reservoir adapted to slidably attach to said launch tube for subsequently receiving air under pressure from said vessel by way of said launcher housing; and, (e) a mechanism to release pressurized air from said vessel through said vessel outlet to said launch tube, comprising:

(1) a well within said vessel, having a well outlet;

(2) a second pressure release valve slidable within said well to isolate the well from the vessel, the well containing a quantity of air;

(3) bias means within the well to bias the second valve into sealing engagement with the vessel outlet, said second valve having a surface with a greater area than a cross sectional area of said vessel outlet;

(4) a first pressure release valve arranged to seal said well outlet, said first valve openable by a manually activated release actuator, whereby, upon activation of said release actuator, said first valve will open, allowing air to exit said well and causing a pressure decrease within said well, said pressure decrease being sufficient to permit said pressurized air within said vessel to press against said surface of said second valve to overcome the force of said bias means to move the second valve away from said vessel outlet to permit said pressurized air to enter the launch tube to launch the rocket.

2. The device of claim 1, wherein said release activator is a button connected to said housing so as to open said first pressure release valve.

3. The device of claim 2 wherein said first pressure release valve is located in linear alignment with said second pressure release valve and arranged such that when said first pressure release valve is opened and causes a pressure drop within said well, the change in pressure within said well causes a movement of said second pressure release valve from a closed position against said vessel outlet to an open position toward said first pressure release valve.

4. The device of claim 2 which further includes a launch safety mechanism having means for deactivating said release activator when said safety mechanism is tilted from a vertical position by an angle greater than a predetermined angle to prevent horizontal or lateral launching.

5. The device of claim 4 wherein said launch safety mechanism includes a funnel trap and ball between said release activator and said first pressure release valve such that said ball seats within a base of said funnel when said mechanism is in a vertical position so as to allow functioning of said activator, permitting said activator to press against said ball to subsequently move a lever to open said first pressure release valve and said ball rolls out of said funnel base when tilted beyond a predetermined angle so as to deactivate said release activator such that said activator will not press against said ball when pressed and will be unable to move said lever to open said first pressure release valve.

6. The device of claim 2 wherein said first pressure release valve and said second pressure release valve rest in said well, said well having a first portion and a second portion and said second pressure release valve is loosely set into at least said second portion of said well and said first pressure release valve is seated in said first portion of said well, such that when said first pressure release valve is opened, a pressure drop occurs in said well so as to move said second pressure release valve toward the first portion of said well and to open said second pressure release valve, and wherein said second pressure release valve is spring biased away from said first portion of said well and said spring has a bias strength which is overcome when said pressure drop occurs.

7. The device of claim 1, wherein said release activator includes a button connected to a rocker arm and said rocker arm is located so as to be rotatable by depression of said button and located so as to open said first pressure release valve upon rotation thereof.

8. The device of claim 7 which further includes a launch safety mechanism having means for deactivating said release activator when said safety mechanism is tilted from a vertical position by an angle greater than a predetermined angle to prevent horizontal or lateral launching.

9. The device of claim 8 wherein said launch safety mechanism includes a funnel trap and ball between said release activator and said first pressure release valve such that said ball seats within a base of said funnel when said mechanism is in a vertical position so as to allow functioning of said activator, permitting said activator to press against said ball to subsequently move a lever to open said first pressure release valve and said ball rolls out of said funnel base when tilted beyond a predetermined angle so as to deactivate said release activator such that said activator will not press against said ball when pressed and will be unable to move said lever to open said first pressure release valve.

10. The device of claim 7 wherein said first pressure release valve and said second pressure release valve rest in said well, said well having a first portion and a second portion and said second pressure release valve is loosely set into at least said second portion of said well and said first pressure release valve is seated in said first portion of said well, such that when said first pressure release valve is opened, a pressure drop occurs in said well so as to move said second pressure release valve toward the first portion of said well and to open said second pressure release valve, and wherein said second pressure release valve is spring biased away from said first portion of said well and said spring has a bias strength which is overcome when said pressure drop occurs.

11. The device of claim 1 wherein said first pressure release valve is located in linear alignment with said second pressure release valve and arranged such that when said first pressure release valve is opened and causes a pressure drop within said well, the change in pressure within said well causes a movement of said second pressure release valve from a closed position against said vessel outlet to an open position toward said first pressure release valve.

12. The device of claim 11 which further includes a launch safety mechanism having means for deactivating said release activator when said safety mechanism is tilted from a vertical position by an angle greater than a predetermined angle to prevent horizontal or lateral launching.

13. The device of claim 12 wherein said launch safety mechanism includes a funnel trap and ball between said release activator and said first pressure release valve such that said ball seats within a base of said funnel when said mechanism is in a vertical position so as to allow functioning of said activator, permitting said activator to press against said ball to subsequently move a lever to open said first pressure release valve and said ball rolls out of said funnel base when tilted beyond a predetermined angle so as to deactivate said release activator such that said activator will not press against said ball when pressed and will be unable to move said lever to open said first pressure release valve.

14. The device of claim 11 wherein said first pressure release valve and said second pressure release valve rest in said well, said well having a first portion and a second portion and said second pressure release valve is loosely set into at least said second portion of said well and said first pressure release valve is seated in said first portion of said well, such that when said first pressure release valve is opened, a pressure drop occurs in said well so as to move said second pressure release valve toward the first portion of said well and to open said second pressure release valve, and wherein said second pressure release valve is spring biased away from said first portion of said well and said spring has a bias strength which is overcome when said pressure drop occurs.

15. The device of claim 1 which further includes a second one-way valve connected to said pump which permits flow of air from said vessel only upon pressurization of said vessel above a predetermined pressure level.

16. The device of claim 1 which further includes a launch safety mechanism having means for deactivating said release activator when said safety mechanism is tilted from a vertical position by an angle greater than a predetermined angle to prevent horizontal or lateral launching.

17. The device of claim 16 wherein said launch safety mechanism includes a funnel trap and ball between said release activator and said first pressure release valve such that said ball seats within a base of said funnel when said mechanism is in a vertical position so as to allow functioning of said activator, permitting said activator to press against said ball to subsequently move a lever to open said first pressure release valve and said ball rolls out of said funnel base when tilted beyond a predetermined angle so as to deactivate said release activator such that said activator will not press against said ball when pressed and will be unable to move said lever to open said first pressure release valve.

18. The device of claim 16 wherein said first pressure release valve and said second pressure release valve rest in said well, said well having a first portion and a second portion and said second pressure release valve is loosely set into at least said second portion of said well and said first pressure release valve is seated in said first portion of said well, such that when said first pressure release valve is opened, a pressure drop occurs in said well so as to move said second pressure release valve toward the first portion of said well and to open said second pressure release valve, and wherein said second pressure release valve is spring biased away from said first portion of said well and said spring has a bias strength which is overcome when said pressure drop occurs.

19. The device of claim 1 wherein said first pressure release valve and said second pressure release valve rest in said well, said well having a first portion and a second portion and said second pressure release valve is loosely set into at least said second portion of said well and said first pressure release valve is seated in said first portion of said well, such that when said first pressure release valve is opened, a pressure drop occurs in said well so as to move said second pressure release valve toward the first portion of said well and to open said second pressure release valve, and wherein said second pressure release valve is spring biased away from said first portion of said well and said spring has a bias strength which is overcome when said pressure drop occurs.

* * * * *